United States Patent [19]

Chesnut

[11] Patent Number: 4,781,111

[45] Date of Patent: Nov. 1, 1988

[54] APPARATUS FOR INDICATING LEVEL OF COMPACTED TRASH IN TRASH COMPACTOR

[75] Inventor: Paul B. Chesnut, Armstrong Township, Vanderburg County, Ind.

[73] Assignee: Whirlpool Corporation, Benton Harbor, Mich.

[21] Appl. No.: 945,899

[22] Filed: Dec. 24, 1986

[51] Int. Cl.[4] ..... B30B 15/06

[52] U.S. Cl. ..... 100/99; 100/229 A; 116/204; 340/686

[58] Field of Search ..... 100/229 A, 99, 57; 116/204; 340/686; 62/127; 236/94

[56] References Cited

U.S. PATENT DOCUMENTS

| | | | |
|---|---|---|---|
| 1,218,544 | 3/1917 | Genter | 100/99 X |
| 2,082,364 | 6/1937 | Store | 175/183 |
| 3,198,903 | 8/1965 | Chafee, Jr. | 200/87 |
| 3,594,740 | 7/1971 | Comeau | 340/183 |
| 3,822,638 | 7/1974 | Merkin | 100/99 X |
| 3,862,595 | 1/1975 | Longo | 100/229 A X |
| 3,918,359 | 11/1975 | Hennels et al. | 100/99 |
| 3,988,981 | 11/1976 | McDonald | 100/99 |
| 4,050,373 | 9/1977 | Hellmann | 100/229 A |
| 4,064,451 | 12/1977 | Foxworthy | 324/207 |
| 4,073,228 | 2/1978 | Henzl | 100/52 |
| 4,073,229 | 2/1978 | O'Rourke et al. | 100/98 R |
| 4,165,501 | 8/1979 | Bongort et al. | 335/206 |
| 4,384,184 | 5/1983 | Alvarez | 200/84 C |
| 4,387,578 | 6/1983 | Paddock | 62/127 |
| 4,422,402 | 12/1983 | Ogihara | 111/67 A |
| 4,445,923 | 5/1984 | Shetterly | 65/158 |
| 4,603,625 | 8/1986 | Brown | 100/99 X |
| 4,620,479 | 11/1986 | Diamond et al. | 100/229 A X |
| 4,665,891 | 5/1987 | Nemec et al. | 99/447 X |

FOREIGN PATENT DOCUMENTS

| | | | |
|---|---|---|---|
| 480803 | 3/1938 | United Kingdom | 100/99 |

*Primary Examiner*—Andrew M. Falik

*Attorney, Agent, or Firm*—Wood, Dalton, Phillips, Mason & Rowe

[57] ABSTRACT

An analog indicator for indicating the upper level of compacted trash in a trash compactor container. The indicator provides an analog indication of the travel of the ram into the container during a compaction operation and, in the illustrated embodiment, displays a bar graph having a variable vertical extent corresponding to the ram travel, thereby indicating the upper level of the compacted trash in the container relative to a preselected maximum level at the time of a compaction operation. An actuating element is mounted to the ram for operating switches associated with a plurality of lamps providing the analog indication.

12 Claims, 1 Drawing Sheet

APPARATUS FOR INDICATING LEVEL OF COMPACTED TRASH IN TRASH COMPACTOR

TECHNICAL FIELD

This invention relates to trash compactors and in particular to means for indicating the amount of compacted trash in the compactor.

BACKGROUND ART

The use of trash or refuse compactors has recently become quite popular. Because of the normal bulkiness of household trash and the like, the use of conventional trash collecting means has necessitated an annoying requirement for frequent transfer from the household collecting location to a dispensing location, such as an outdoor garbage can, or the like. Such a problem is particularly vexatious for apartment dwellers, high-rise residents, and the like because of the limitations on storage space and inconvenience of disposal.

A problem arises, however, in the use of such trash compactors in that, at times, the user finds that the compactor is completely full of compacted trash. Such a condition can occur at inopportune times.

DISCLOSURE OF INVENTION

The present invention comprehends a solution to this vexatious problem which is extremely simple and economical.

More specifically, the invention comprehends the provision in a trash compactor having a trash receiving container, a ram, and means for selectively forcibly urging the ram into the container for compacting trash placed therein, of indicating means for indicating the upper level of compacted trash in the container relative to a preselected maximum level so that the user will know the status of the level of trash in the compactor and be able to act appropriately in accordance therewith.

More specifically, the invention comprehends the provision in such a trash compactor of means for indicating the amount of travel of the ram below the preselected level during a trash compacting operation.

It is conventional to provide means for reversing the direction of the ram upon the ram sensing the desired compaction of the newly introduced trash material to the compacting container. The invention comprehends means for indicating the level at which such reversal occurs so as to provide an analog of the compacted trash level in the container.

In the illustrated embodiment, the actuating means is movable in correspondence to the travel of the ram.

In the illustrated embodiment, the means responsive to the actuating means comprises a plurality of switches and display means selectively operated by the switches.

In the illustrated embodiment, the actuating means comprises a magnetic strip which successively operates different ones of a plurality of lamps defining the display means.

The compactor includes a drawer in which the compaction is effected, and in the illustrated embodiment, the display means is mounted on the front wall of the drawer.

The scale may be provided with markings corresponding to the plurality of lamps in the display means.

The improved trash compactor of the invention providing improved indication of the level of the compacted trash therein is extremely simple and economical of construction, while yet providing the highly desirable features discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
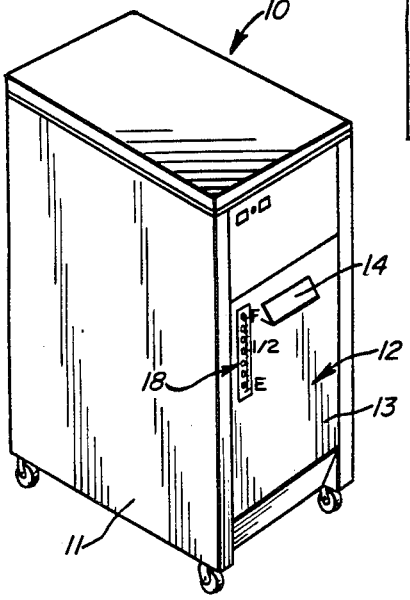
FIG. 1 is a perspective view of a trash compactor embodying the invention.

In the illustrative embodiment of the invention as disclosed in the drawing, a trash compactor generally designated 10 is shown to include a cabinet 11. A compaction drawer 12 is provided with a front wall 13 having a handle 14 for selective disposition of the drawer in the retracting position shown in FIG. 1, and an exposed forwardly disposed position (not shown) in which trash may be placed into the drawer.

Figure 2:
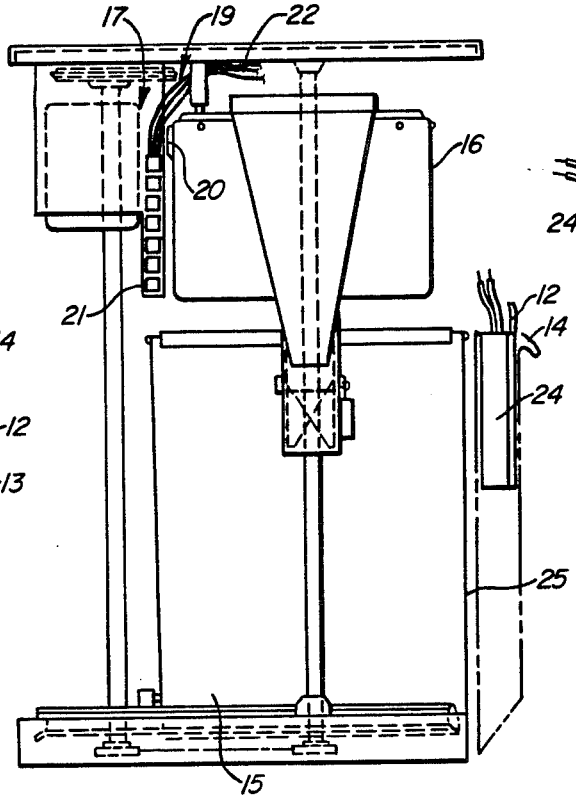
FIG. 2 is a fragmentary vertical section thereof illustrating the association of the actuating means associated with the ram for providing the indication of the compacted trash level.
Figure 3:
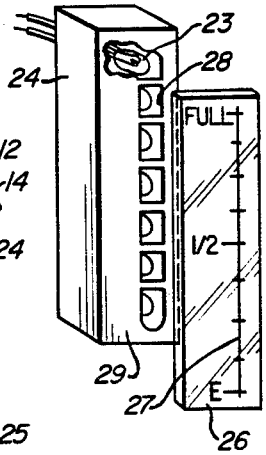
FIG. 3 is an exploded perspective view illustrating one form of indicating means for use in carrying out the invention, a portion of the lamp housing being broken away to illustrate in greater detail a lamp used in the indicating means.

As further shown in FIG. 2, a compaction container 15 is provided in drawer 12 subjacent a ram 16 when the ram is in a retracted disposition. A drive 17 is provided for selectively lowering the ram into the container 15 for effecting compaction of refuse placed in the container, and retracting the ram to the retracted position of FIG. 2 upon completion of the compaction operation. Such automatic drive of the ram is conventional and requires no further description herein.

As discussed above, it is desirable, in the use of such trash compactors, to advise the user thereof of the need to remove the compacted trash when the container is effectively full.

The present invention comprehends the provision in such a compactor of indicating means for indicating the upper level of compacted trash in the container relative to a preselected maximum level thereof. More specifically, the invention comprehends the provision of means for indicating the travel of the ram below an upper full level of the container.

Thus, as shown, the invention comprehends the provision of indicating means generally designated 18 and actuating means generally designated 19 cooperatively associated for indicating the level of the compacted trash in container 15.

As shown in FIG. 2, the actuating means 19 includes a magnetic strip 20 mounted for travel with the ram 16 adjacent a vertical array of reed switches 21. The reed switches are connected by suitable electrical cables 22 to a corresponding plurality of lamps 23 mounted in a housing 24 carried on the front wall 13 of drawer 12 forwardly of the front wall 25 of container 15. A light-transmitting scale element 26 is provided in overlying relationship to the housing 24 and includes a scale marking 27 having divisions coordinated with the location of the respective lamps 23 in the housing 24 aligned with openings 28 in the front wall 29 of the housing.

Figure 4:
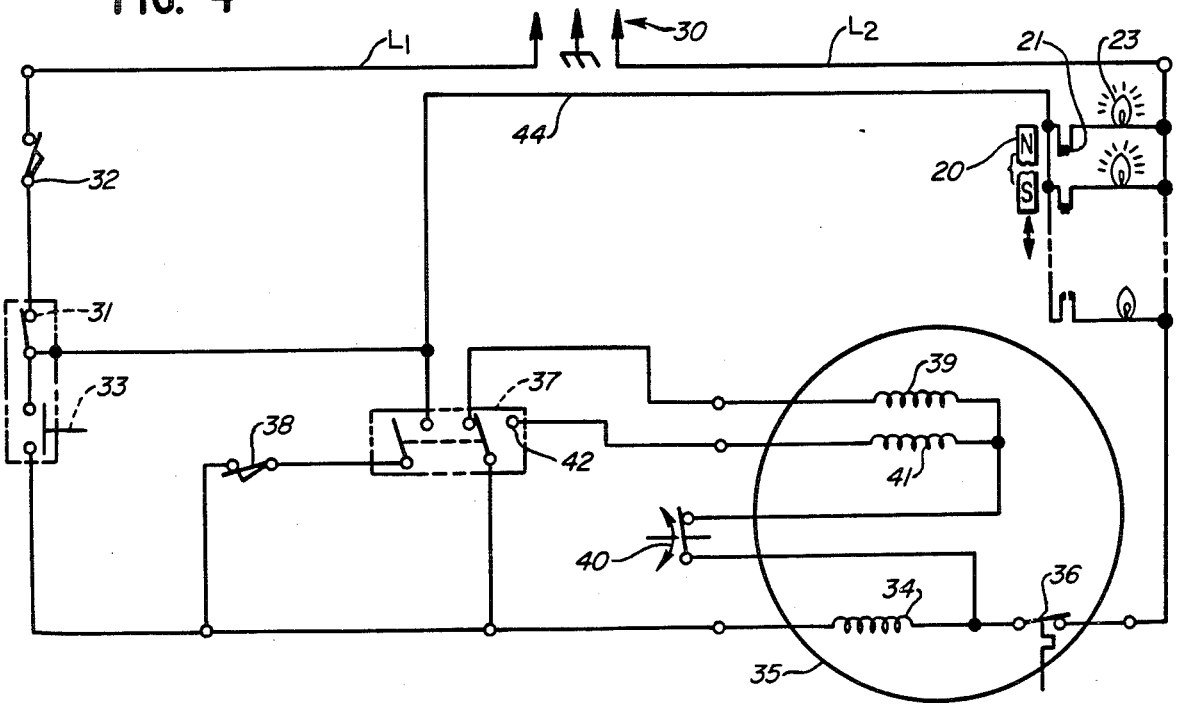
FIG. 4 is a schematic wiring diagram illustrating the control circuitry of the trash compactor.

The operation of compactor 10, including the selective operation of lamps 23, is best understood with respect to the schematic wiring diagram of FIG. 4. As shown therein, power is provided to the compactor from a conventional power source 30, such as from a conventional 120-volt, 60-cycle power receptacle. Power is delivered to a run switch generally designated 31, through a drawer safety switch 32. In series with run switch 31 is a start switch 33 connected through the run winding 34 of a drive motor 35 of drive 17. The run winding is connected through a motor protector overload switch 36 through power supply lead L2.

The run switch is connected through a top limit-directional switch generally designated 37, having one set of contacts connected through a drawer tilt switch 38 to the run winding 34. The clockwise start winding 39 of motor 35 is connected through a second set of contacts of switch 37 to run winding 34. The counterclockwise winding is connected through a motor centrifugal switch 40 to between the run winding 34 and motor protector 36. The clockwise start winding is further connected through a counterclockwise start winding 41 to a normally open contact 42 of the second set of contacts of switch 37.

Run switch 31 is further connected through a lead 44 to the plurality of lamps 23 connected in parallel between lead 44 and power supply lead L2 through the reed switches 21.

The magnetic strip 20 carried on ram 16 is disposed adjacent the reed switches 21, as previously discussed, so that as the ram travels downwardly into the receptacle 15, additional lamps are illuminated so as to provide a bar graph effect and an analog of the ram movement into the container. The analog indication provides a visual feedback to the user so that each time the compactor is operated, the user is apprised of the level of compacted refuse in the container 15.

More specifically, when the container 15 is empty, the ram 16 travels fully downwardly thereinto before being reversed by the motor centrifugal switch and counterclockwise start winding 41. Under such a condition, all of the lamps 23 are illuminated to indicate to the user that the entire height of the container is available for receiving trash to be compacted.

As the level of compacted trash in the container 15 rises, reversal of the downward movement of the ram is effected at progressively higher and higher levels, which change is indicated by the limitation and the downward extent of the array of illuminated lamps 23 behind the scale 27.

When the level of the compacted trash in container 15 reaches the full level, only the topmost lamp 23 is illuminated so as to illuminate the portion of scale 27 indicating this full condition.

In the illustrated embodiment, the translucent scale element 26 comprises smoked glass so as to provide an improved bar graph indication of the level of compacted trash in the container.

Thus, the invention comprehends the provision in a trash compactor of indicating means for indicating the upper level of compacted trash in the trash receiving container relative to a preselected maximum, or full, level. The indicating means provides a visual analog display corresponding to the travel of the ram, which is viewable by the user at the time of operation of the compactor to effect a compacting operation relative to newly deposited trash.

In the illustrated embodiment, the improved indicating means comprises means for indicating the amount of travel of the ram below the full level during the trash compacting operation. The means for actuating the indicating means comprises means movable in correspondence with the travel of the ram and, in the illustrated embodiment, the actuating means comprises magnetically operated switch means associated one each with respective ones of an array of indicating lamps providing the analog and travel display.

In the illustrated embodiment, the display is mounted in the front wall of the trash compactor drawer for ready viewability by the user.

The foregoing disclosure of specific embodiments is illustrative of the broad inventive concepts comprehended by the invention.

I claim:

1. In a trash compactor having a trash receiving container, a ram, and means for selectively forcibly urging the ram into the container for compacting trash placed therein, improved indicating means for indicating the upper level of compacted trash in said container relative to a preselected maximum level comprising means for indicating the amount of travel of the ram below said preselected level during a trash compacting operation including magnetic actuating means movable in correspondence with the travel of the ram, and means responsive to movement of the actuating means comprising a plurality of magnetically operated reed switches and display means selectively operated by said switches.

2. In a trash compactor having a trash receiving container, a ram, and means for selectively forcibly urging the ram into the container for compacting trash placed therein, improved indicating means for indicating the upper level of compacted trash in said container relative to a preselected maximum level comprising means for indicating the amount of travel of the ram below said preselected level during a trash compacting operation including actuating means movable in correspondence with the travel of the ram, said actuating means comprising magnetic operating means, and said indicating means further including means responsive to movement of the actuating means.

3. The trash compactor structure of claim 2 wherein said means responsive to movement of the actuating means comprises magnetically operated switch means.

4. The trash compactor structure of claim 2 wherein said trash receiving container has a front wall and said means for indicating the amount of travel of the ram comprises indicating means mounted on said front wall.

5. The trash compactor structure of claim 2 wherein said trash receiving container has a front wall and said means for indicating the amount of travel of the ram comprises means providing a visual display on said front wall.

6. The trash compactor structure of claim 2 wherein said trash receiving container comprises a movable drawer having a front wall provided with a handle for use in manually moving the drawer and said means for indicating the amount of travel of the ram comprises indicating means mounted on said front wall adjacent said handle.

7. The trash compactor structure of claim 2 wherein said means for indicating the amount of travel of the ram comprises a plurality of indicating lamps.

8. The trash compactor structure of claim 2 wherein said means for indicating the amount of travel of the ram comprises a plurality of indicating lamps and said means responsive to movement of the actuating means comprises means for cumulatively sequentially energizing said lamps.

9. The trash compactor structure of claim 2 wherein said means responsive to movement of the actuating means comprises a vertical light transmissive scale and lamps selectively illuminated by said actuating means to be visible through said scale.

10. The trash compactor structure of claim 2 wherein said means responsive to movement of the actuating means comprises a vertical light transmissive scale and lamps selectively illuminated by said actuating means to be visible through said scale, said lamps corresponding in number to division markings provided in said scale.

11. In a trash compactor having a housing including a fixed front panel and defining an opening adjacent said panel, a trash receiving container movably mounted to the housing for selective positioning within the housing for compaction of trash in the container and outwardly of the housing for placement of trash therein and means for providing an electric signal corresponding to the upper level of compacted trash in the containers, the trash receiving container having a front wall substantially flush with said opening in a fully inserted position in the housing, the improvement comprising indicating means mounted on said front wall of the movable trash receiving container and electrically connected to said signal providing means for providing an indication of the upper level of compacted trash in the container relative to a preselected maximum level thereof.

12. The trash compactor of claim 11 wherein said trash receiving container front wall is provided with a handle and said indicating means is disposed adjacent said handle.

* * * * *